US006192658B1

(12) United States Patent
Yamagishi et al.

(10) Patent No.: US 6,192,658 B1
(45) Date of Patent: Feb. 27, 2001

(54) METHOD AND APPARATUS FOR FITTING A SHEET-LIKE ARTICLE

(75) Inventors: Akinori Yamagishi, Ishikawa-ken; Eizo Sasaki, Osaka; Takanobu Yamamoto, Kyoto, all of (JP)

(73) Assignees: Shibuya Kogyo Co., Ltd., Ishikawa-ken; Suntory Limited, Osaka, both of (JP)

( * ) Notice: Subject to any disclaimer, the term of this patent is extended or adjusted under 35 U.S.C. 154(b) by 0 days.

(21) Appl. No.: 09/342,413

(22) Filed: Jun. 29, 1999

(30) Foreign Application Priority Data

Jun. 30, 1998 (JP) ..... 10-199629
Jun. 30, 1998 (JP) ..... 10-199630
Jun. 30, 1998 (JP) ..... 10-199631

(51) Int. Cl.[7] ..... B65B 61/00
(52) U.S. Cl. ..... 53/415; 53/136.1; 29/775
(58) Field of Search ..... 53/398, 399, 413, 53/415, 134.1, 474, 445, 246, 585, 135.1, 136.1, 48.1, 299; 29/775

(56) References Cited

U.S. PATENT DOCUMENTS 3,439,404 * 4/1969 Pearson ..... 29/775
4,213,283 * 7/1980 Calvert et al. ..... 53/48.1
5,412,859 * 5/1995 Hubbs ..... 53/137.1
5,537,801 * 7/1996 Granbakken et al. ..... 53/48.1

FOREIGN PATENT DOCUMENTS 7-13708 3/1995 (JP) .
7-503441 4/1995 (JP) .
7-156088 6/1995 (JP) .
8-301243 11/1996 (JP) .

* cited by examiner

*Primary Examiner*—Linda Johnson
(74) *Attorney, Agent, or Firm*—Flynn, Thiel, Boutell & Tanis, P.C.

(57) ABSTRACT

A case 6 is intermittently conveyed on a box transfer conveyor 8, and contains vessels 4 disposed in an array of four vessels in a longitudinal row and three vessels in a transverse row. A magazine introduction conveyor 18 is disposed to extend in a direction orthogonal to the conveyor 8, and a robot 24 is disposed adjacent to a crossing between the both conveyors. The robot has four grips 36 mounted thereon, each having suckers 66 and a retaining plate 68 which maintains a leaflet 12 declined downward. The leaflet includes a fixture 12*b* with an opening 12*a* therein and a display piece 12*c* which extends from the fixture. The grips hold attracted a leaflet around the opening in the fixture to remove it from a magazine 16. After the grips are driven into the case to bring the leaflet into abutment against a partition 10, the grips are moved to terminate the abutment, whereupon the lower portion of the leaflet drops into the space defined by the partition, and the grips are centered with respect to the vessel to fit the leaflet around the vessel. In this manner, a fitting of the leaflet around the vessel contained in the case is enabled by using the robot 24, and thus can be automated without requiring a manual intervention.

8 Claims, 12 Drawing Sheets

METHOD AND APPARATUS FOR FITTING A SHEET-LIKE ARTICLE

BACKGROUND OF THE INVENTION AND RELATED ART STATEMENT

The invention relates to a method and an apparatus for fitting a sheet-like article, and more particularly, to such method and apparatus which can be used in fitting a sheet-like article which may be a leaflet as exemplified by a piece of paper printed with an advertisement or the like around the neck of a whisky bottle while the latter is encased.

The leaflet comprises a fixture including an opening which is to be fitted around the neck of a vessel such as a bottle and a display piece integral with the fixture and printed with an advertisement or the like. The opening in the fixture of the leaflet is fitted around the neck of a whisky bottle or any other vessel while allowing the advertisement display piece to extend along the shoulder of the vessel, which is to be exhibited on the shop-front of a liquor dealer for sale.

When fitting the leaflet around a vessel, the conventional practice has been the employment of a number of operators standing along a conveyor on which vessels are being conveyed so that the fixtures of leaflets can be manually engaged around the necks of vessels. The manual fitting of leaflets requires an increased number of operators, which increases with an increasing throughput of the production line, causing an increased labor cost and resulting in an inefficient operation.

OBJECT AND SUMMARY OF THE INVENTION

Accordingly, it is an object of the invention to provide an apparatus for fitting a sheet-like article which enables an automatic fitting of a sheet-like article such as a leaflet around an encased vessel, thereby reducing the need for operating personnel and allowing a higher efficiency and a lower cost of operation to be achieved.

The above object is accomplished by providing an apparatus for fitting a sheet-like article comprising conveying means for conveying a case containing an array of vessels which is formed by a plurality of longitudinal and transverse rows, feed means for feeding a row of sheet-like articles, and holder means for holding sheet-like articles for one row of vessels, the sheet-like articles held by the holder means being simultaneously fitted around the vessels in either longitudinal or transverse one row.

The apparatus which fits a sheet-like article such as a leaflet around a vessel contained in a case may be constructed to achieve a fitting operation automatically by using a robot. In this instance, a robot holds part (fixture) of the leaflet attracted thereto, inserts an end of the display piece of the leaflet into a clearance between a partition of the case and a vessel, and finally fits the opening of the fixture around the neck of the vessel. However, only part (the fixture) of the leaflet is held attracted by suction means of the robot while the remaining part (display piece used for advertisement or the like) remains to be freely movable. Accordingly, as the robot removes and holds the leaflet attracted thereto from a magazine and moves toward the case which contains vessels, the freely movable part of the leaflet rocks up and down, preventing an accurate positioning when the end of the display piece is to be inserted between the partition and the vessel and frequently resulting in a failure of insertion.

It is then another object of the invention to provide a method of fitting a sheet-like article in which when a sheet-like article is to be fitted around the neck of a vessel, the sheet-like article is positioned accurately and inserted into a case containing vessels in a reliable manner to be fitted around the neck of a vessel, and an apparatus for fitting a sheet-like article which carries out the method.

This object is accomplished by providing a method of fitting a sheet-like article, having a fixture with an opening adapted to be fitted around the neck of a vessel and a contiguous part extending from the fixture, around a vessel contained in a case having a partition, comprising the steps of holding a portion of the sheet-like article located adjacent to the fixture with holder means, bringing the holder means to a position above the case, bringing the lower surface of the portion adjacent to the fixture into abutment against a top end of the partition at a location adjacent to a particular vessel around which the sheet-like article is to be fitted while maintaining said portion depending downward, moving the holder means toward the particular vessel while maintaining the abutment until the holder means is located above the particular vessel, whereupon the sheet-like article is released from abutment against the top end of the partition, and fitting the sheet-like article around the particular vessel while maintaining the article in a space defined by the partition in which the particular vessel is received.

The above second object is also accomplished by providing an apparatus for fitting a sheet-like article, having a fixture with an opening adapted to be fitted around the neck of a vessel and a contiguous part extending from the fixture, around a vessel contained in a case having a partition, comprising holder means for holding a portion of the sheet-like article located adjacent to the fixture, and moving means for moving the holder means up and down and also in a horizontal direction, said moving means moving the portion of the sheet-like article adjacent to the fixture downward while maintaining said portion declined downward and bringing the lower surface of said portion into abutment against a top end of the partition at a location adjacent to a particular vessel around which the sheet-like article is to be fitted, said moving means effecting a relative movement between the holder means and the case to bring the holder means toward the particular vessel while maintaining the abutment until the holder means is located above the particular vessel, whereupon the sheet-like article is released from abutment against the top end of the partition, subsequently the moving means moving the holder means down to fit the sheet-like article around the particular vessel while maintaining the article in a space defined by the partition in which the particular vessel is received.

When transferring the holder means while the latter holds only part of the sheet-like article, namely, the fixture, attracted thereto, a rocking motion of the remaining part, namely, the display piece serving as an advertisement, may cause a jamming thereof with the partition of the case. In particular, when the display piece is in a folded form to increase its weight, the rocking motion thereof is greatly amplified to further worsen the likelihood of causing a trouble when it is tried to fit the fixture around the neck of the vessel.

It is therefore a further object of the invention to provide an apparatus for fitting a sheet-like article that is provided with holder and transfer means which allows a sheet-like article to be transferred in a stable attitude without causing an unstable rocking motion thereof.

The third object is accomplished by providing an apparatus for fitting a sheet-like article around the neck of a vessel, comprising holder and transfer means including a suction unit at its bottom which holds part of the article attracted thereto from above and for transferring the sheet-like article, the holding and transferring means also including a retainer member capable of an elevating motion relative to the suction unit, the retainer member having a lower end which extends below the sheet-like article as it is held attracted by the suction unit, whereby the sheet-like article is transferred while it is held down.

DETAILED DESCRIPTION OF THE PREFERRED EMBODIMENT

Figure 1:
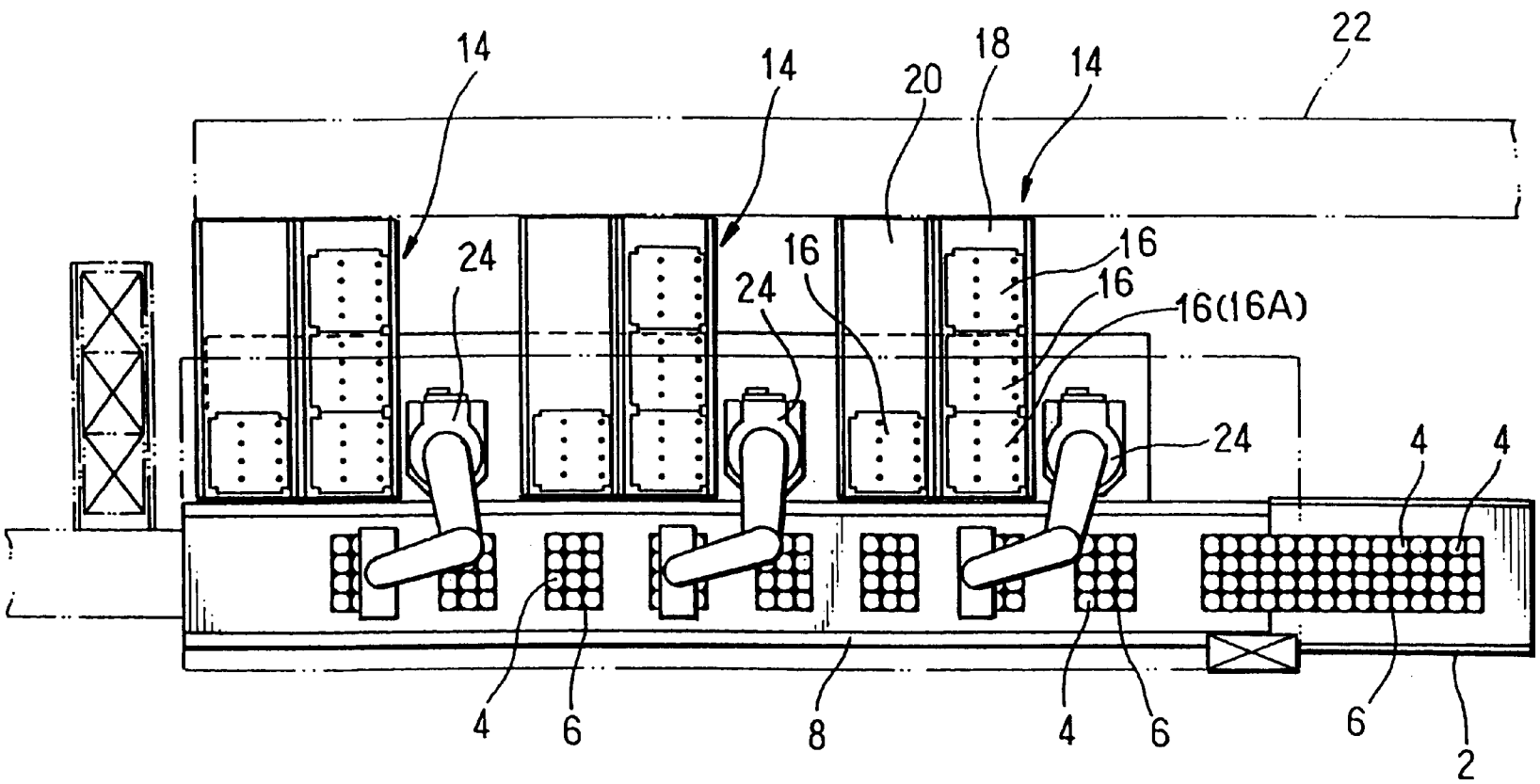
FIG. 1 is a plan view of an entire apparatus for fitting a sheet-like article according to one embodiment of the invention.

The invention will now be described with reference to an embodiment thereof shown in the drawings. In FIG. 1, there is shown a box introduction conveyor 2 which conveys cases 6 in succession, each case 6 being loaded with vessels 4 by a caser in a preceding step. In the present example, each case 6 contains four vessels in a longitudinal row which extends lengthwise of the case 6 and three vessels in a transverse row or a total of twelve vessels 4. It is to be noted that the box introduction conveyor 2 is operated continuously. A box transfer conveyor 8 which is arranged for intermittent motion is disposed at a downstream end of the box introduction conveyor 2, and operates to separate the cases 6 which have been conveyed in succession on the conveyor 2 at a given interval and to convey the individual case 6 intermittently to bring it to a stop at a given location. It is to be noted that in order to prevent the loaded vessels 4 to abut or impact against each other to cause a damage or a breakage thereof, a partition 10 which separate individual vessels 4 runs both longitudinally and transversely of each case, thus defining a space in which one vessel 4 is received (see FIG. 14(*b*)).

Figure 2:
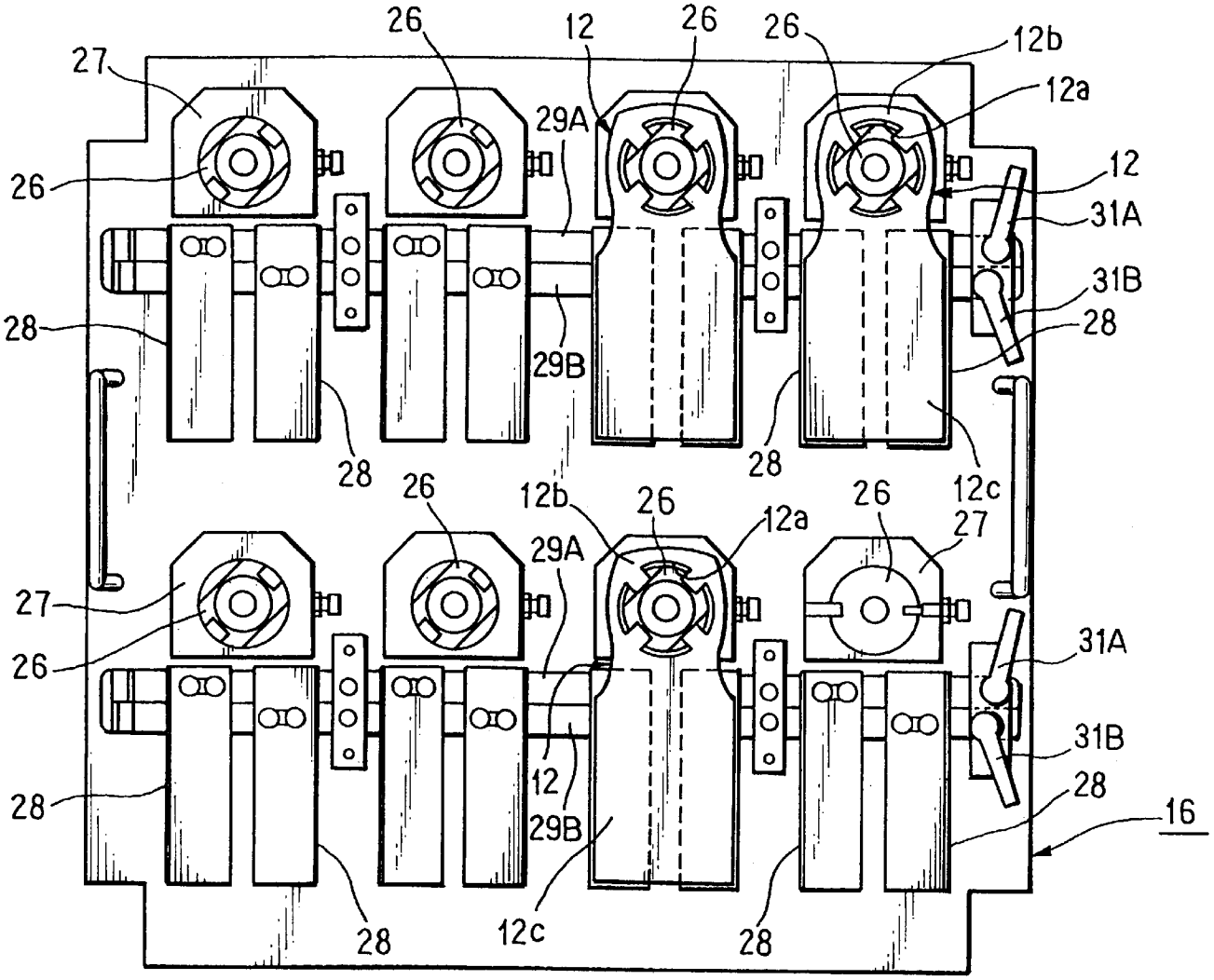
FIG. 2 is a plan view of a leaflet feed magazine provided in the apparatus shown in FIG. 1.

Feed means 14 for feeding leaflets 12, such as sheet-like articles, which are to be fitted around the neck of respective vessels 4 is provided alongside the box transfer conveyor 8 (see FIG. 2 showing a magazine carrying leaflets). The leaflet feed means 14 comprises a magazine introduction conveyor 18 which conveys a magazine 16 carrying a plurality of leaflets 12 to a position adjacent to one side of the box transfer conveyor 8, and a magazine discharge conveyor 20 which discharges the magazine 16 after the leaflets 12 placed thereon are removed therefrom. The magazine introduction conveyor 18 and the magazine discharge conveyor 20 run in parallel relationship with each other in a direction orthogonal to the box transfer conveyor 8. A stopper, not shown, is provided at the downstream end of the magazine introduction conveyor 18 to bring the magazine 16 being conveyed to a stop at a location adjacent to the box transfer conveyor 8. It is to be noted that the magazines 16 on the both conveyors 18, 20 are carried in and out from or to a tray conveyor 22 extending parallel to the box transfer conveyor 8.

A robot 24 is disposed near each crossing between the box transfer conveyor 8 and the magazine introduction conveyor 18 for taking one of the leaflets 12 from the magazine 16 and for fitting it around the neck of one of the vessels 4 in the case 6. A packing head to be described later is mounted on the robot 24 for taking out the leaflets 12 one by one from the magazine 16 which remains stationary at the downstream end (or leaflet removal position) of the magazine introduction conveyor 18, such magazine being also designated by 16A, thus allowing each of the leaflets to be fitted around each vessel 4 contained in the case 6 located on the box transfer conveyor 8.

In the example shown, the robot 24 is designed to fit the leaflets 12 simultaneously around four vessels 4 disposed in one longitudinal row of the case 6, and thus the robot 24 take out four leaflets 12 simultaneously from the magazine 16. It will be seen that each case 6 has three longitudinal rows of vessels 4, and a single robot 24 operates to fit leaflets 12 from one longitudinal row around the vessels. Accordingly, three robots 24 and corresponding three leaflet feed means 14 are disposed alongside the box transfer conveyor 8.

Figure 3:
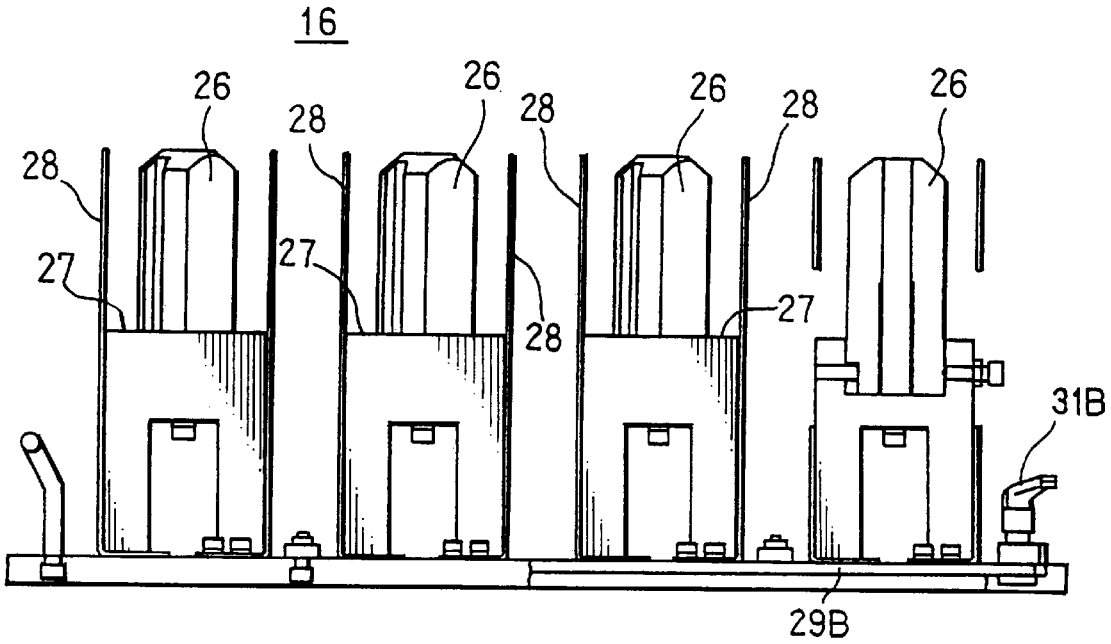
FIG. 3 is a front view of the magazine.

Referring to FIG. 2 which is a plan view of the magazine 16, it will be noted that in the present embodiment, the leaflet 12 includes a fixture 12*b* having an opening 12*a* which is adapted to be fitted around the neck of the vessel 4, and a display piece 12*c* extending contiguously from the fixture 12*b* and having an advertisement or the like printed thereon. As shown in FIGS. 2 and 3, the magazine 16 has two rows of four upright leaflet support rods (or support members) 26 around which the openings 12*a* in the fixtures 12*b* of the leaflets 12 are fitted. The magazine 16 also includes guide plates 28, each pair of guide plates being located on the opposite sides of the display piece 12*c* when the opening 12*a* in the leaflet 12 is fitted around the support rod 26, thereby holding the display piece 12*c*. The pair of opposing guide plates 28 are mounted on a pair of adjuster plates 29A, 29B which are disposed to extend in a direction orthogonal to the guide plates 28. These adjuster plates 29A can be moved lengthwise thereof, or in the left-and-right direction as viewed in FIG. 2, by operating a pair of levers 31A, 31B. A relative movement between the both adjuster plates 29A, 29B is effective to adjust a spacing between the both guide plates 28. Accordingly, the spacing between the both guide plates 28 can be suitably adjusted when the size of the leaflet 12 which is to be fitted around the vessel 4 is changed.

Figure 4:
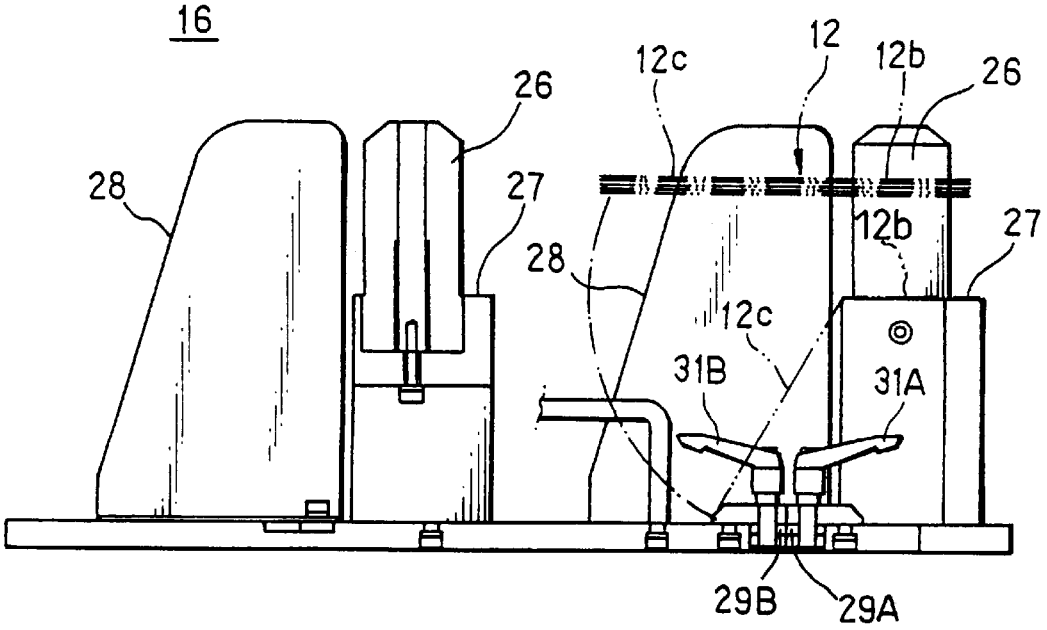
FIG. 4 is a side elevation of the magazine.

Each support rod 26 has a base 27 at its bottom, and the fixture 12*b* of the leaflet 12 rests on the base 27 in a stack when it is fitted around the support rod 26 while the display piece 12*c* depends downwards, as shown in FIG. 4. It is sufficient for the purpose of the invention that the magazine 16 has a number of support rods 26 which are equal in number to the number of vessels 4 disposed in one longitudinal row around which the leaflets 12 are simultaneously fitted. Accordingly, four support rods 26 may be disposed in one row, or three rows may be provided each row including four support rods 26. Alternatively, an arrangement can be made such that the leaflets 12 may be simultaneously fitted around the vessels 4 disposed in one transverse row, which are equal to three in the present example. In this instance, three support rods 26 may be disposed in one row, or a plurality of such rows may be provided.

A packing head 30 is mounted on the robot 24 for holding a leaflet 12 by suction to remove it from the magazine 16 and for fitting it around one of the vessels 4. Referring to FIGS. 5 to 9, it is to be noted that the leaflets 12 are disposed in a stack of multiple layers on the support rods 26 of the magazine 16, and the packing head 30 is adapted to be mounted on the body of the robot 24 by using a mounting plate 32 and a mounting rod 34, both located at the top end thereof (see FIGS. 5 and 9). The packing head 30 includes four grips 36 disposed in one row so that the leaflets 12, one from each of the four support rods 26, can be held attracted thereto, such grips being designated by 36A, 36B, 36C and 36D, as viewed from the left in FIG. 5.

Each grip 36 is mounted on the lower end of a vertical rod 38 (which are designated by 38A, 38B, 38C and 38D corresponding to the grips 36A, 36B, 36C and 36D, respectively). These vertical rods 38 are disposed to be elevatable by vertically extending through slide blocks 42 (42A, 42B, 42C and 42D) which are slidably supported by a pair of horizontally extending parallel guide rods 40A and 40B. Each of the vertical rods 38 is normally urged downward by a spring 44 disposed between projections 42*a*, 42*b* (see FIG. 6) formed at upper and lower ends of the slide block 42.

Figure 10:
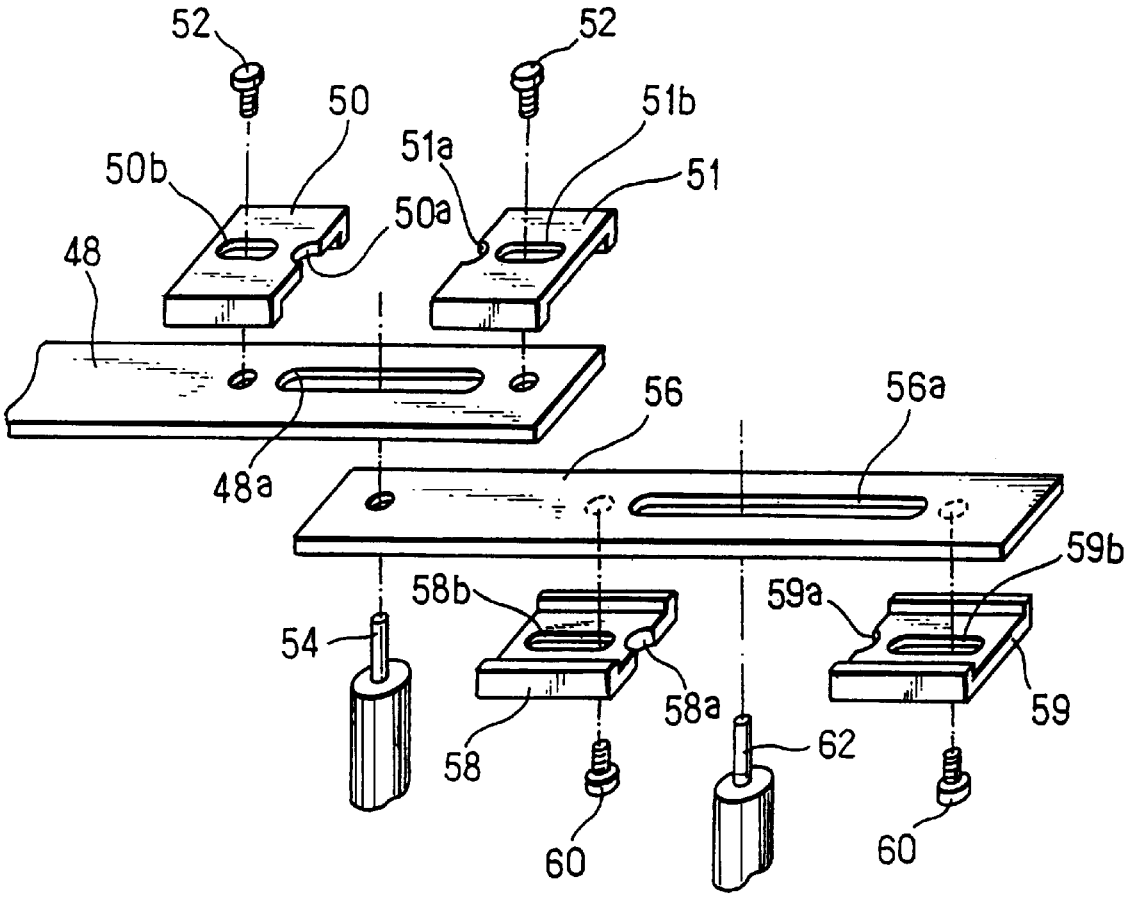
FIG. 10 is an exploded perspective view illustrating a mechanism for adjusting the spacing between grips of the packing head.

It will be noted that the four slide blocks 42 which support the grips 36 can be moved along the guide rods 40A, 40B to adjust a spacing therebetween. A mechanism which adjusts the spacings between the grips 36 will now be described with reference to FIGS. 5 and 10. An intermediate block 46 is centrally located along the pair of parallel guide rods 40A, 40B and fixedly carries a first plate 48. A pair of smaller plates 50, 51 are mounted on each side of the first plate 48. Each plate 50, 51 is formed with an elongate slot 50*b*, 51*b*, respectively, through which bolts 52 are passed to be connected to the first plate 48, thereby allowing the positions of the plates 50, 51 relative to the first plate 48 to be changed within an extent permitted by the elongate slots 50*b*, 51*b*.

The opposing edges of the pair of plates 50, 51 are formed with semicircular notches 50*a*, 51*a*. At a location below the semicircular notches 50*a*, 51*a*, the first plate 48 is formed with an elongate slot 48*a*. On the other hand, pins 54 are mounted on the slide blocks 42B, 42C through which the inner two vertical rods 38B, 38C are supported, and each of the pins 54 extends through the elongate slot 48*a* in the first plate 48 to be situated in a space located between the opposing semicircular notches 50*a*, 51*a* formed in the plates 50, 51. In this manner, the pin 54 is permitted to move through a distance corresponding to a spacing between the semicircular notches 50*a*, 51*a* in the plates 50, 51. In addition, the inner slide blocks 42B, 42C as well as the grips 36B, 36C which are supported by the slide blocks 42B, 42C through the vertical rods 38B, 38C are allowed to move along the guide rods 40A, 40B within an extent which is allowed for the movement of the pin 54 between the semicircular notches 50*a*, 51*a*.

A second plate 56 is secured to the pin 54 on each of the inner two slide blocks 42B, 42C. As a consequence, the second plate 56 is also allowed to move through a distance corresponding to the spacing between the semicircular notches 50*a*, 51*a* formed in the plates 50, 51 on the first plate 48. Each of the second plates 56 is secured to one of the inner slide blocks 42B, 42C at its one end or its end located toward the center located between the adjacent ends of the pair of the second plates 56 and has two smaller plates 58, 59 mounted on the lower surface thereof at its intermediate portion and its other end. The plate 58, 59 are also formed with elongate slots 58*b*, 59*b*, through which bolts 60 extend to be connected to the second plate 56, thereby allowing the positions of the plates 58, 59 to be changed relative to the second plate 56, as permitted by the lengths of the elongate slots 58*b*, 59*b*.

The opposing edges of the plates 58, 59 disposed on each side are formed with semicircular notches 58*a*, 59*a*, and the second plate 56 is formed with an elongate slot 56*a* in a region located above the semicircular notches 58*a*, 59*b*. Pins 62 mounted on the slide blocks 42A, 42D which support the two outer vertical rods 38A, 38D extend through the elongate slot 56*a* in the second plate 56 and are also situated between the semicircular notches 58*a*, 59*a*. In this manner, the pin 62 is permitted to move through a distance corresponding to the spacing between the semicircular notches 58*a*, 59*a* formed in the plates 58, 59. In addition, the outer slide blocks 42A, 42D as well as the grips 36A, 36D which are supported by these slide blocks 42A, 42D can move through a distance corresponding to the distance through which the pin 62 is permitted to move between the semicircular notches 58*a*, 59*a*.

Thus, the two inner slide blocks 42B, 42C of the four slide blocks 42 which support associated grips 36 are movable in an extent defined by the semicircular notches 50*a*, 51*a* formed above the first plate 48 while the two outer slide blocks 42A, 42D are movable in a range defined by the semicircular notches 58*a*, 59*a* disposed below the second plate 56 relative to the second plate 56 which moves together with the inner slide blocks 42B, 42C. In this manner, a spacing between the four grips 36 (namely, 36A, 36B, 36C and 36D) can be increased or decreased within a given extent. In the present embodiment, when attracting the leaflets 12, the spacing between the grips 36 (36A, 36B, 36C and 36D) is equal to each other and coincides with the spacing between the support rods 26 on the magazine 16. However, when fitting the leaflets 12 around the vessels 4 in the case 6, the spacing between the two inner grips 36B, 36C is narrowed while the spacings between the inner grips 36B, 36C and the outer grips 36A, 36D are enlarged. This is because the bottom of the case 6 is not flat as a result of folding flaps. The adjustment of the spacings between the grips 36 is not limited in use when holding the leaflets 12 attracted thereto and when fitting the leaflets around the vessels, but may also be utilized for use with vessels 4 of different sizes.

Figure 5:
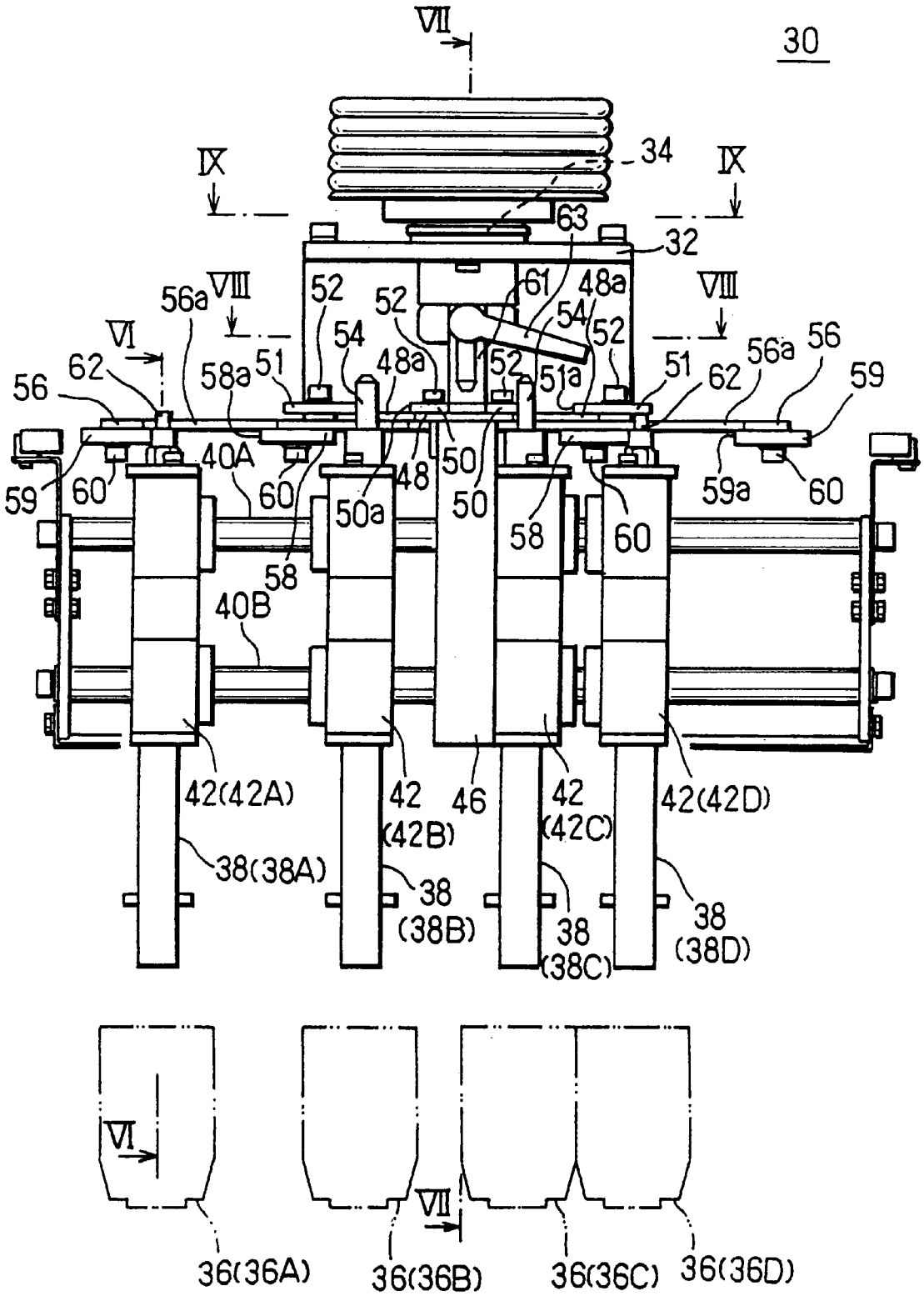
FIG. 5 is a front view of a packing head, partly omitted, which is provided in the apparatus shown in FIG. 1, it being noted that the left-half of the Figure indicating grips spaced apart while the right-half indicates grips with a reduced spacing therebetween.
Figure 7:
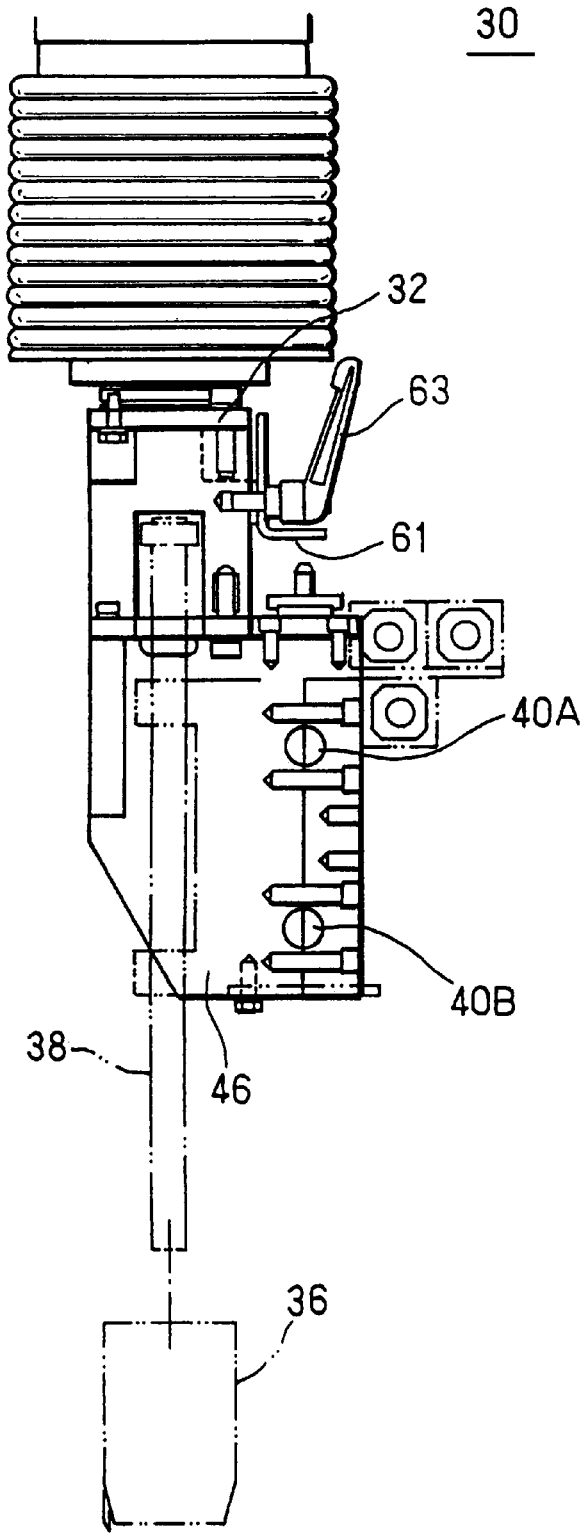
FIG. 7 is a cross section taken along the line VII—VII shown in FIG. 5.

As mentioned above, the four slide blocks 42A, 42B, 42C, 42D are movable through given extents (defined by the spacings between the semicircular notches 50*a*, 51*a* and between the semicircular notches 58*a*, 59*a*). However, the apparatus of the present embodiment can also be used with the vessels 4 of varying sizes. In particular, when the apparatus is to be used with vessels having a size which is greatly different from the previous vessels, the first plate 48 and its associated plates 50, 51 as well as the second plate 56 and its associated plates 58, 59 are changed. In the present embodiment, the plates 48, 50, 51, 56, 58 and 59 are formed as an interchangeable integral attachment. As shown in FIGS. 5 and 7, the integral attachment is held down by an L-shaped plate 61 and is locked in place by turning a lever 63. In FIG. 5, the lever 63 is turned down, whereby the attachment is locked by the L-shaped plate 61. However, in FIG. 7, the lever 63 is turned upward, thus releasing the attachment.

Figure 6:
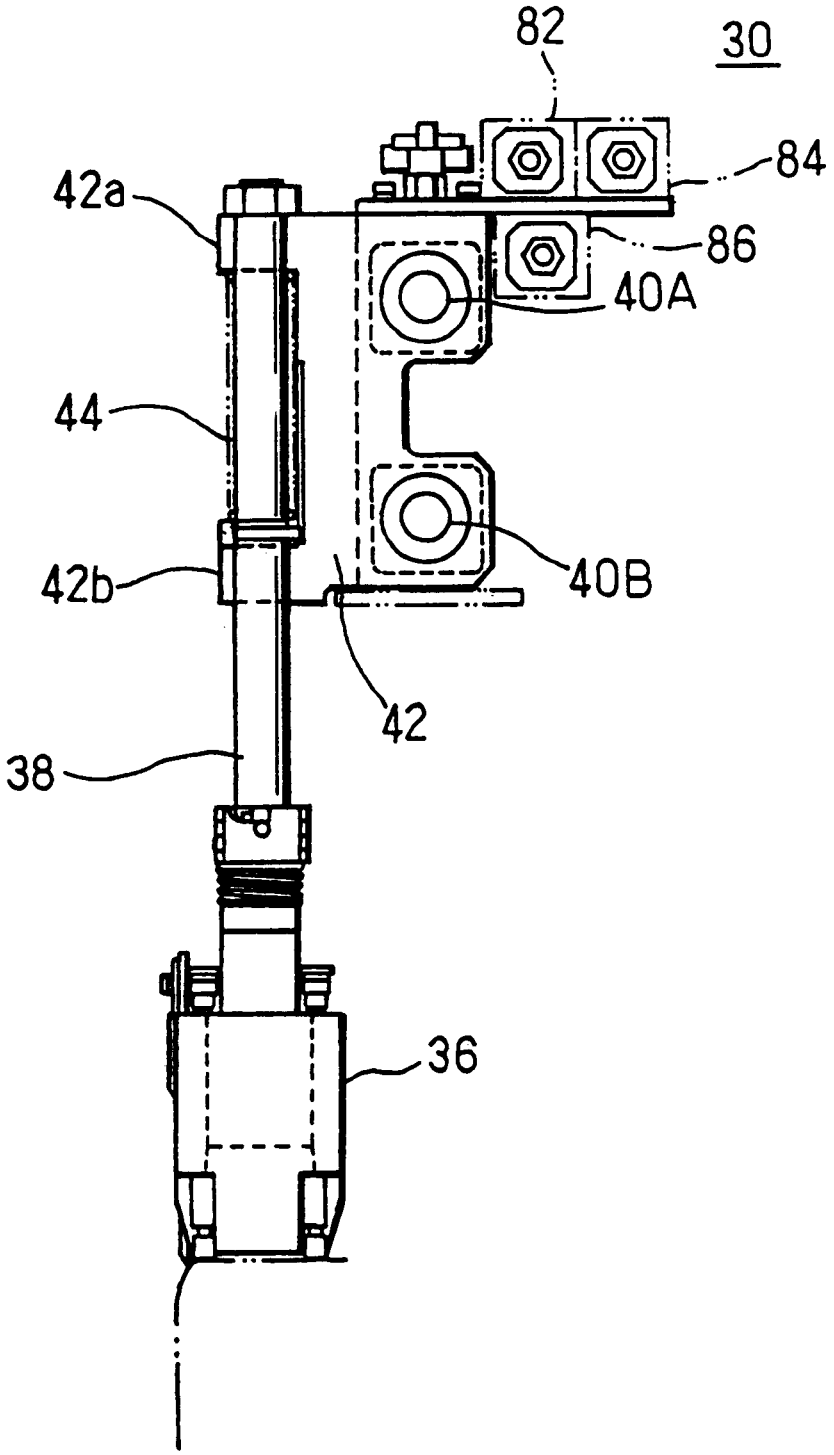
FIG. 6 is a cross section taken along the line VI—VI shown in FIG. 5.
Figure 8:
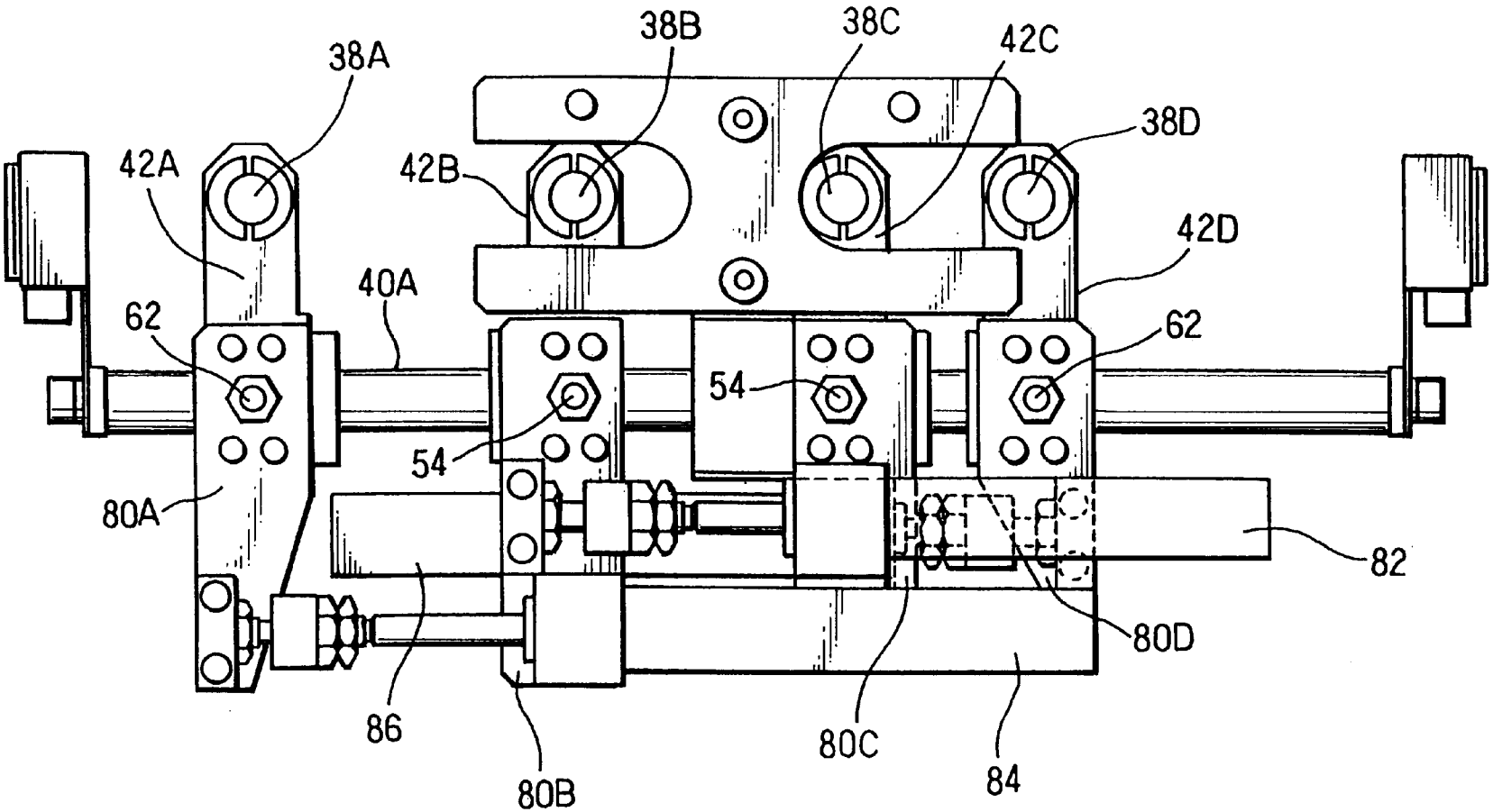
FIG. 8 is a cross section taken along the line VIII—VIII shown in FIG. 5.
Figure 9:
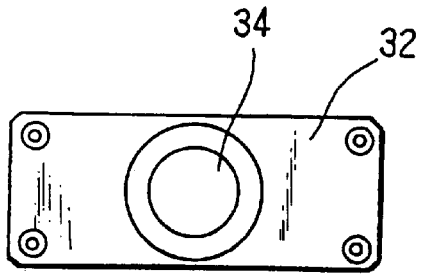
FIG. 9 is a cross section taken along the line IX—IX shown in FIG. 5.

An arrangement for moving the four slide blocks 42A, 42B, 42C and 42D which support the grips 36A, 36B, 36C and 36D, respectively, will now be described with reference to FIGS. 6 and 8.

As shown, a mounting plate 80A, 80B, 80C or 80D is secured on the slide block 42A, 42B, 42C or 42D, respectively. A first cylinder 82 is secured to the upper surface of the mounting plate 80C, which is the third as counted from the left as viewed in FIG. 8, and includes a rod, the end of which is connected to the mounting plate 80B which is the second from the left. As the first cylinder 82 is actuated, the pins 54 mounted on the inner slide blocks 42B, 42C move between the notches 50*a*, 51*a* formed in the plates 50, 51. Specifically, as the rod of the first cylinder 82 extends, the pin 54 on the slide block 42C which is integral with the cylinder body and the pin 54 on the slide block 42B integral with the rod move away from each other and come to a stop upon abutment against the semicircular notches 51*a* in the outer plates 51. Conversely, when the rod of the first cylinder 82 retracts, the pins 54 move toward each other into abutment against the semicircular notches 50*a* formed in the inner plates 50.

A second cylinder 84 is secured on the upper surface of the plate 80B which is the second from the left, and has a rod, the end of which is connected to the left-most mounting plate 80A. Accordingly, as the second cylinder 84 is actuated, the pin 62 mounted on the left-most slide block 42A moves between the notches 58*a*, 59*a* formed in the plates 58, 59. Furthermore, a third cylinder 86 is secured to the lower surface of the mounting plate 80C which is the third from the left, and has a rod, the end of which is connected to the lower surface of the right-most mounting plate 80D. As the third cylinder 86 is actuated, the pin 62 mounted on the right-most slide block 42D moves between the notches 58*a*, 59*a* formed in the plates 58, 59.

Figure 11:
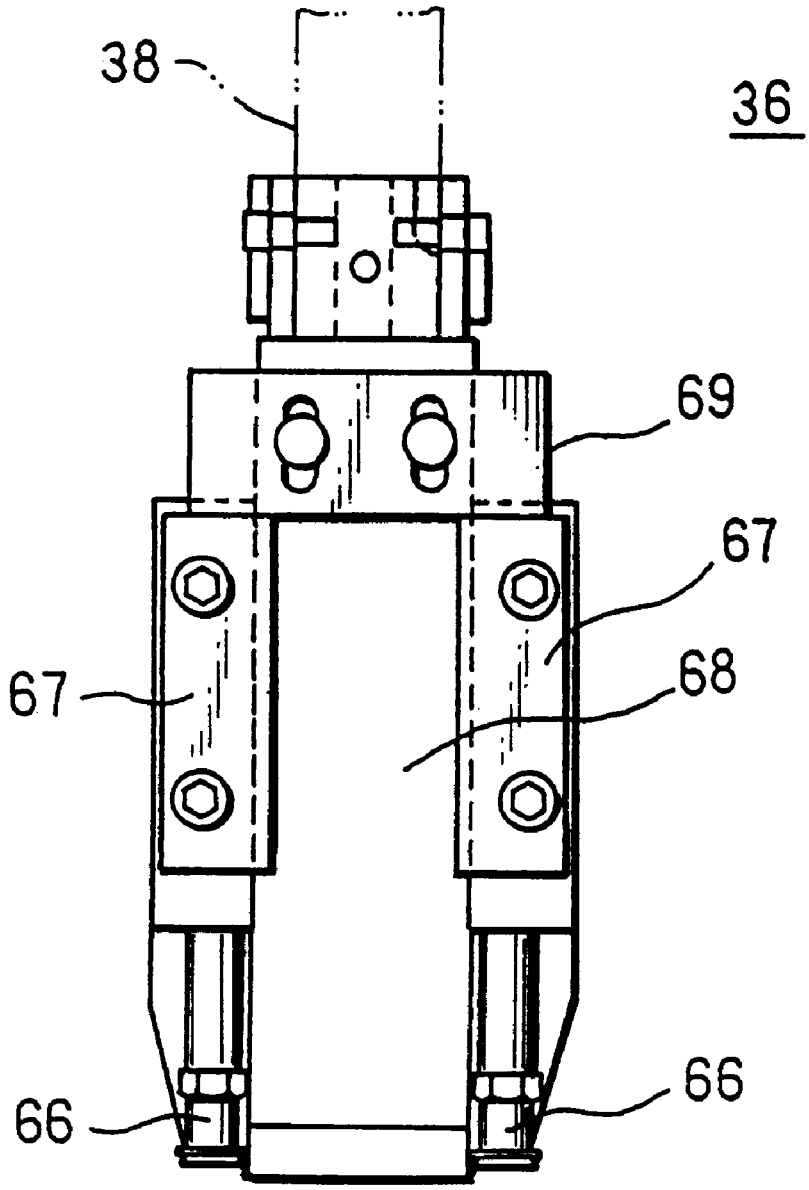
FIG. 11 is a rear view of the grip.
Figure 12:
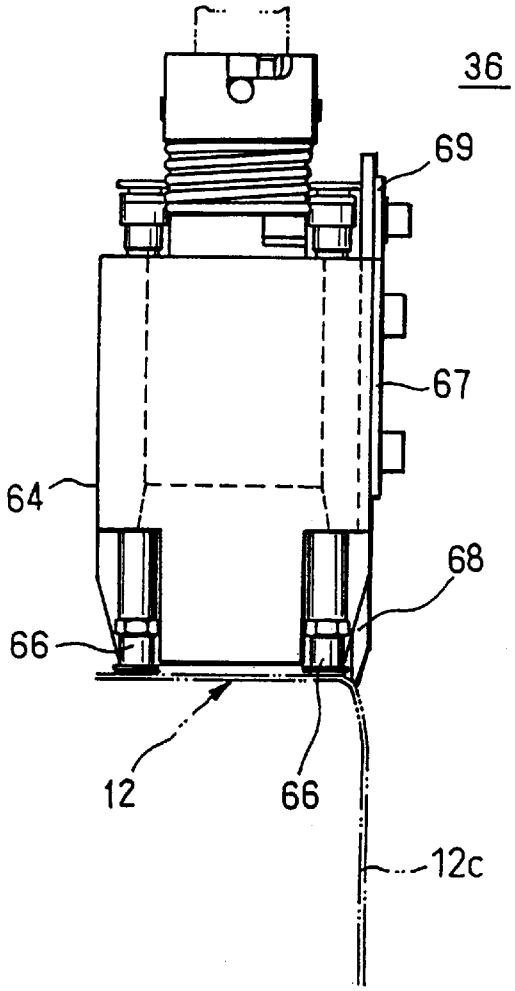
FIG. 12 is a side elevation of the grip.
Figure 13:
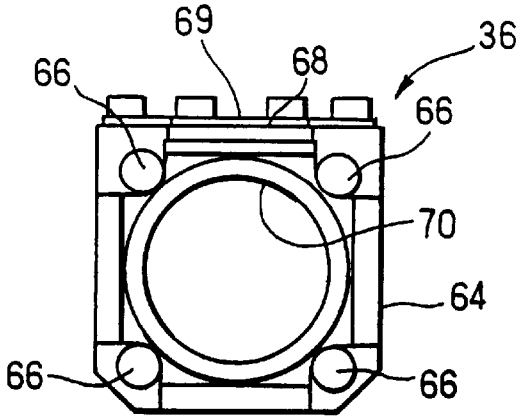
FIG. 13 is a bottom view of the grip.

The construction of the grip 36 mounted on the packing head 30 will now be described with reference to FIGS. 11 to 13. Each grip 36 comprises a prism-shaped body 64 having suckers 66 mounted on four corners thereof, these four suckers 66 holding the fixture 12*b* of the leaflet 12 around the circumference of the opening 12*a*. A retaining plate 68, serving as means for holding the display piece 12*c* of the leaflet 12 as declined downward, is mounted on one lateral surface of the body 64 and is disposed between a pair of holding plates 67 which are located on the opposite sides thereof so as to cover the front surface of the retaining plate 68, whereby the retaining plate 68 is vertically slidable. The retaining plate 68 normally falls down by gravity, and in its fallen position, the lower end of the retaining plate projects slightly below the suckers 66 (see FIG. 11). However, the retaining plate can slide upward when it is pushed up from downside. The top of the retaining plate 68 is connected to a free fall preventing plate 69, which abuts against the upper ends of the holding plates 67 as the retaining plate 68 falls down, thus defining its fallen position. As shown in FIG. 13 which is a bottom view, the lower surface of the body 64 is formed with a circular space 70, into which the free end of the support rod 26 or the head of the vessel 4 is inserted when taking the leaflets 12 from the support rod 26 or when fitting the leaflet 12 around the vessel 4.

The operation of the apparatus for fitting a sheet-like article constructed in the manner mentioned above will now be described. Cases 6 in which the vessels 4 are loaded by a caser, not shown, are conveyed in succession on the box introduction conveyor 2 which is continuously operated, and are then transferred onto the box transfer conveyor 8 which is intermittently operated, whereby the cases 6 are conveyed intermittently at a given spacing therebetween and come to a stop at a given position. A plurality of leaflets 12 are supported on each of the support rods 26, which are disposed in an array of two rows of four rods on the magazine 16, by fitting the opening 12*a* in the fixture 12*b* around the support rod 26. The magazine 16 which carries a multiplicity of leaflets 12 is conveyed on the introduction conveyor 18 to a position adjacent to the box transfer conveyor 8, which defines a removal position, where it motion is interrupted by a stop, not shown.

When the magazine 16 comes to a stop at the downstream end of the introduction conveyor 18, the robot 24 becomes operative, moving the packing head 30 to a position above the four leaflets 12 on the magazine 16 which are disposed rearward as viewed in the travelling direction of the cases 6 or to the right as viewed in FIG. 1. The arrangement is such that at this time, the four suckers 66 mounted on each grip 36 (namely, each of 36A, 36B, 36C and 36D) are positioned to surround the openings 12*a* in the fixtures 12*b* of the leaflets 12 or the support rods 26 on the magazine 16 while the retaining plate 68 is positioned between the fixture 12*b* and the display piece 12*c*. The packing head 30 is moved down while maintaining such positions, thus allowing the four grips 36 to hold the four leaflets 12 attracted thereto simultaneously (see FIG. 14(*a*)). During this operation, when the packing head 30 is moved down to urge the suckers 66 of the grips 36 against the leaflets 12, the retaining plate 68 which is mounted on one lateral surface of each grip 36 in a vertically slidable manner is pushed upward by the associated leaflet 12.

Figure 14A:
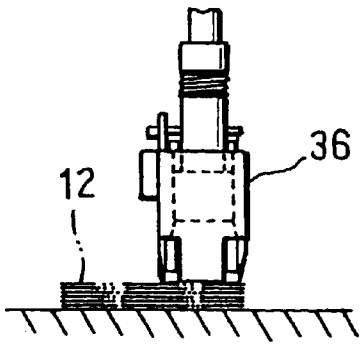
FIGS. 14(*a*), (*b*) and (*c*) are schematic views illustrating a sequence of operations of the apparatus for fitting a sheet-like article.
Figure 14B:
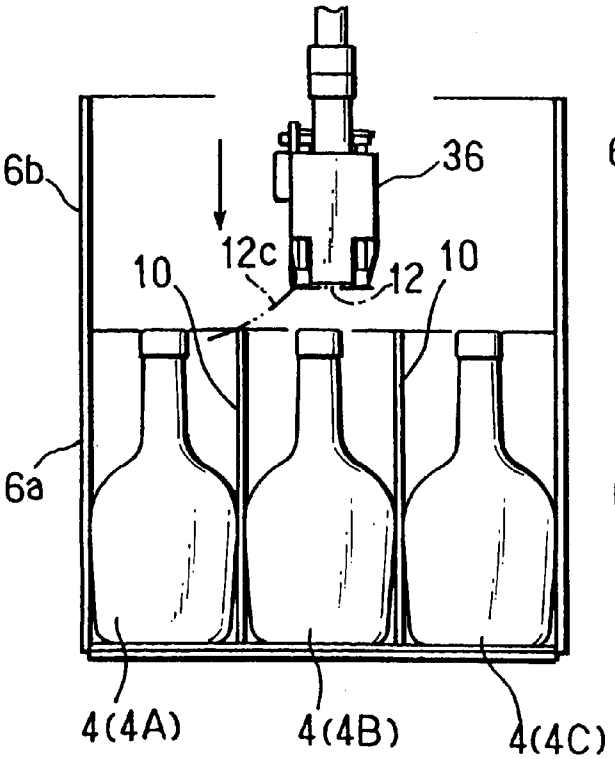
Figure 14C:
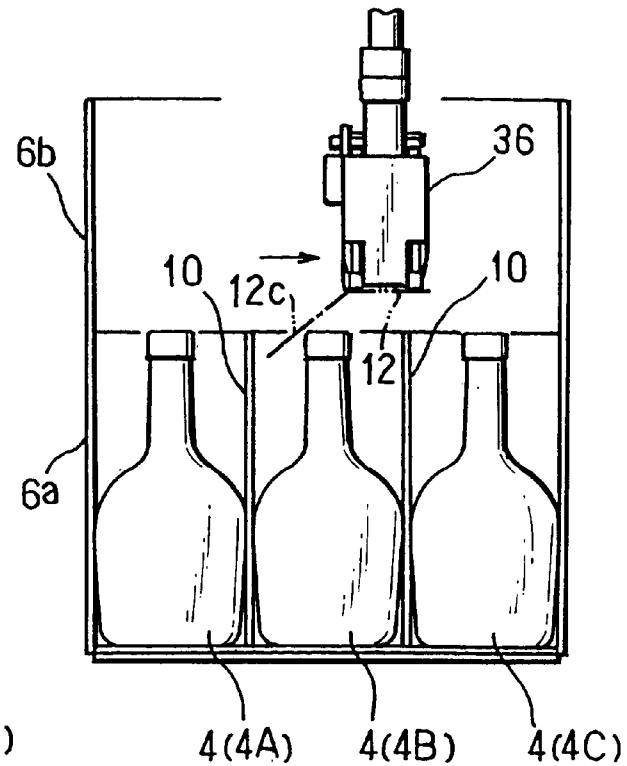
Figures 15A, 15B, 15C:
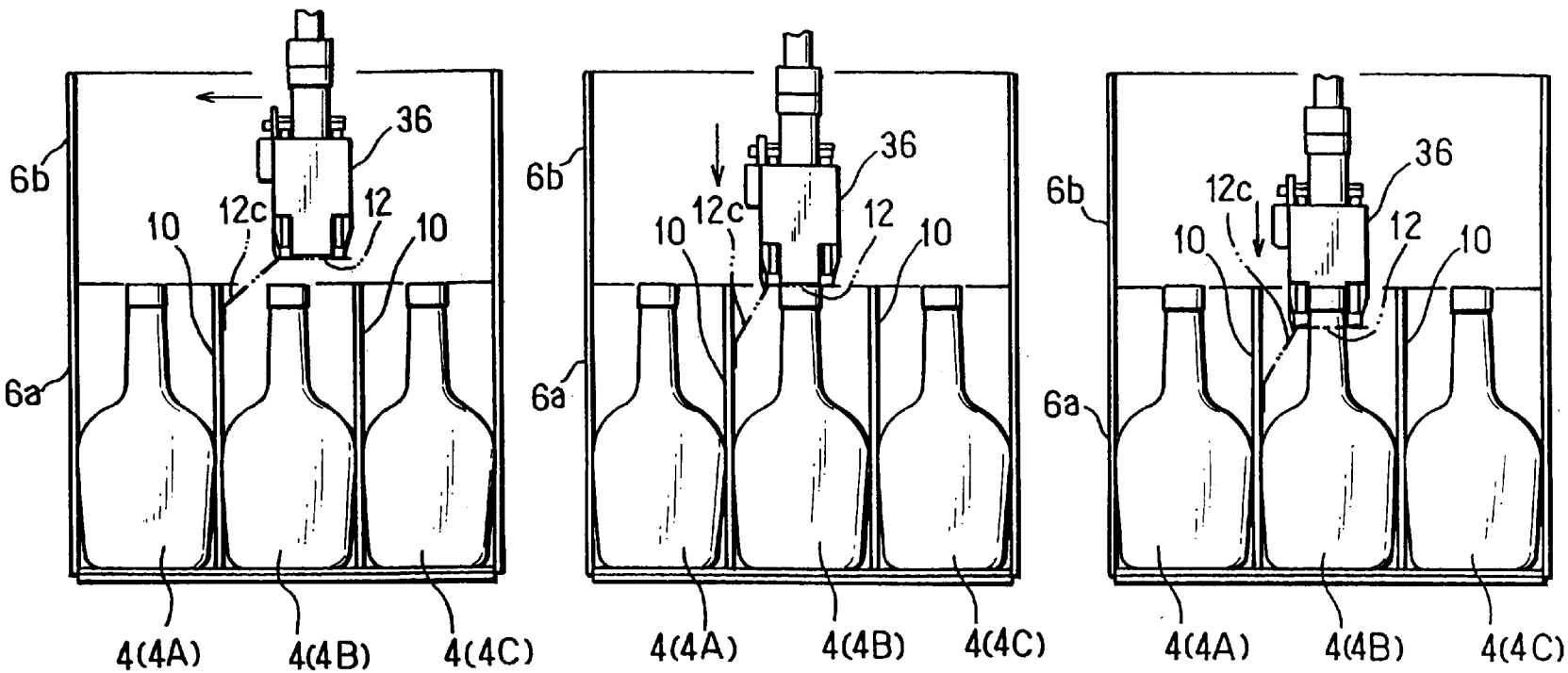
FIGS. 15(*a*), (*b*) and (*c*) are schematic views illustrating a subsequent sequence of operations of the apparatus.

In the present embodiment, three robots 24 operate to fit the leaflets around the vessels 4 in each of the three longitudinal rows in the case 6 in a sequential manner, and FIGS. 14 and 15 depict the operation of fitting the leaflets 12 around the vessels 4 disposed in the middle row in the case 6 (thus vessels 4B) by using the middle robot 24 shown in FIG. 1.

After each grip 36 has held attracted one of the leaflets 12 on the magazine 16, the packing head 30 is driven upward, whereupon the uppermost leaflet 12 is removed from the stack. The retaining plate 68 which has been urged upward by the associated leaflet 12 then moves down by gravity, thus depressing the display piece 12*c* of the leaflet 12 downward (see FIG. 12). In this manner, as the leaflet 12 is removed from the magazine 16, the retaining plate 68 depresses the leaflet 12 downward as the grip 36 moves upward, whereby a double pick of the leaflets 12 can be prevented.

The robot 24 then moves the packing head 30 to a position above the case 6 which remains stationary on the box transfer conveyor 8, located forwardly thereof. Since a portion of the leaflet 12 which is not held attracted, namely, the display piece 12*c*, is depressed by the retaining plate 68, it will be seen that during the movement of the packing head 30, an upward rocking of the display piece as well as a downward rocking which occurs as a reaction thereto are reduced, thus greatly suppressing a vertical rocking of the display piece. Referring to FIGS. 14 and 15, an exemplary step of fitting the leaflet 12 will be described. The robot 24 initially moves the packing head 30 to a position where the display piece 12*c* of the leaflet 12 is located above the vessel 4 in the left-most row (or 4A). When the packing head 30 is allowed to move down under this condition, the depressed portion of the leaflet 12 or the display piece 12*c* will abut against the top end of the partition 10 located between the vessel 4 in the middle row (or 4B) and the vessel 4 in the left-most row (or 4A) (see FIG. 14(*b*)).

The packing head 30 is now moved in the horizontal direction from the position above the vessel 4 in the middle row (or 4B) to a position above the vessel 4 in the right-most row (or 4C) while maintaining the described condition. The portion of the leaflet 12 which is depressed then slides over the top end of the partition 10, and when the lower end of the leaflet has passed the partition 10, it enters a space within the partition 10 in which the middle vessel 4 (or 4B) is received (see FIG. 14(*c*)). At this time, the fixture 12*b* of the leaflet 12 which is held attracted by the grip 36 has passed a position which is directly above the neck of the vessel 4 in the middle row (or 4B), and hence the packing head 30 is then driven back until the center of the vessel 4B is aligned with the axis of the grip 36 (FIG. 15(*a*)). In the present embodiment, the packing head 30 is moved to change the relative position between the leaflet 12, the vessel 4 and the partition 10, but it should be understood that the relative position between the leaflet 12 and the vessel 4 or the partition 10 may be achieved by running the box transfer conveyor 8 which carries the cases 6.

When the grip 36 moves backward, the depressed portion of the leaflet 12 is urged against the inner surface of the partition 10, whereby its end is forced down. When the vessel 4B and the grip 36 are aligned with each other, the grip 36 is moved down (see FIG. 15(*b*)). When the grip 36 is moved down in this manner, the opening 12*a* in the fixture 12*b* of the leaflet which is held attracted by the grip 36 is fitted around the neck of the vessel 4B, and the neck of the vessel 4B is inserted into the space 70 formed in the grip 36 (see FIG. 15(*c*)). When the opening 12*a* in the fixture 12*b* of the leaflet 12 is fitted around the neck of the vessel 4B, the display piece 12*c* of the leaflet 12 will be concurrently depressed to the level of the shoulder of the vessel 4B, whereby the leaflet can be fitted around the vessel 4B in a stable manner. The suction applied by the suckers 66 of the grip 36 is now terminated to free the leaflet 12, and the grip 36 is then moved upward in preparation to the next operation. It will be understood from the foregoing that with the method and the apparatus for fitting a sheet-like article according to the invention, an accurate positioning is enabled while preventing a rocking motion of the sheet-like article during movement, thus minimizing a failure of fitting.

When fitting the leaflets 12 around the vessels 4C disposed in the right-most row, the operation takes place in the similar manner as mentioned above for fitting the leaflets 12 around the vessels 4B disposed in the middle row in the case 6 with reference to FIGS. 14 and 15. However, when fitting the leaflets around the vessels 4A disposed in the left-most row, the fitting of the leaflets 12 cannot take place in the similar manner as before because there is a flap 6*b* extending above a sidewall 6*a* of the case 6. Accordingly, when fitting the leaflets around the vessels 4A, the grips 36 are moved to a position above the case 6 so that the leaflets 12 which are held by the grips 36 are situated inside the flap 6*b*. Subsequently, the grips 36 are moved to a position above the vessels 4A in the left-most row, whereby the depressed portion of the leaflet 12 or the display piece 12*c* can be urged against the flap 6*b* and the sidewall 6*a* of the case 6 and the center of the grip 36 may aligned with the center of the vessels 4A. The grips 36 may then be moved down to fit the leaflets 12 around the necks of the vessels 4A. Again, the present embodiment allows the sheet-like articles to be automatically fitted around the vessels in the case without requiring a manual intervention, improving the efficiency and drastically reducing the labor cost.

In the present embodiment, three robots 24 are provided, each of which operates to fit the leaflets 12 around the vessels 4 disposed in one longitudinal row, but it is also possible to employ a single robot 24 and to operate it a plurality of times, for example, three times. Nevertheless, if a different operation is required depending on the arrangement of the vessels 4 in rows, it is preferred to use different robots 24 with a plurality of rows in order to avoid a complication in controlling the operation of the robots. As has been described above, in the present embodiment, the grips 36 are moved in the same direction for each of the three longitudinal rows of vessels 4A, 4B and 4C disposed in the case 6 in order to fit the leaflets 12 around the vessels 4. However, the direction of movement of the grips 36 may be inverted for only the vessels 4A in the left-most row. In this instance, the leaflets 12 can be fitted around the vessels 4A in the left-most row by using the operation which utilizes the partition 10 in the similar manner as for the vessels 4C in the right-hand row without using the flap 6*b*. However, it is to be noted that in this instance, the leaflets 12 would be fitted around the vessels 4A in the left-most row while facing in the opposite direction.

As mentioned above, the cases, each of which contains the vessels 4 in three longitudinal rows, are carried by the box transfer conveyor 8, which is intermittently operated, and are sequentially brought to a stop at positions located in front of the three robots 24, fitting the leaflets 12 around the vessels for each row by each robot 24. It will be seen that when the robots 24 fit the leaflets 12, which are removed from the magazine 16, around the vessels 4 in the cases 6 which are intermittently fed, the number of leaflets stored on the magazine 16 will decrease sequentially. In the present example, 90 leaflets 12 are stacked on each support rod 26 of the magazine, and 80 leaflets of these leaflets are removed while the remaining 10 leaflets are left as a reserve. As mentioned previously, the magazine 16 carries two sets of four support rods 26. Accordingly, when 80 leaflets 12 are removed from the support rods 26 which are in the rear set, as viewed in the travelling direction of the cases 6, the next supply of leaflets 12 takes place from the support rod 26 in the front set, as viewed in the travelling direction of the cases 6, of the same magazine 16. Subsequently, the empty magazine 16 (though 10 leaflets remain in actuality) is driven by a pusher, not shown, onto the discharge conveyor 20 to be discharged while the next magazine 16 is introduced onto the introduction conveyor 18.

When the leaflets are removed one by one from the stack containing a number of leaflets, which is 90 leaflets in the present example, the elevation of the stack of the leaflets 12 decreases gradually. Accordingly, the stroke by which the grips 36 are moved down is reduced by a given decrement after a given number of leaflets has been removed. For example, the stroke of downward movement of the grips is reduced by 0.5 mm after two leaflets 12 have been removed. It will be understood that the stroke of the downward movement of the grips 36 can be suitably changed depending on the thickness of the leaflet 12.

In the embodiment described above, the four grips 36 mounted on the packing head 30 operate to fit the leaflet 12 around four vessels 4 in one row simultaneously. However, in certain instances, it may be only required that the leaflets 12 be fitted around only the vessels 4 which is as small as one half the vessels in the total case 6. In such instance, one inner and one outer grips 36 may be removed, using only two grips 36 in the fitting operation.

In the embodiment described above, the retaining plate 68 has been used to retain the leaflet 12 so as to cause the display piece 12*c* to be declined downward. However, it is also possible to incline the grips 36 themselves to decline the leaflet 12 so that its lower surface is brought into abutment against the top end of the partition without using the retaining plate 68. It is also to be noted that the leaflet is held attracted only at its one end, namely, at the fixture 12*b*, and accordingly the other end or the display piece 12*c* may depend downward by gravity depending on the paper quality of the leaflet. In such instance, it is unnecessary to provide declining means such as the retaining plate 68.

What is claimed is:

1. A method of fitting a sheet-like article including a fixture with an opening formed therein which is adapted to be fitted around the neck of a vessel and a portion extending from the fixture around a vessel which is contained in a case having a partition, comprising the steps of holding the sheet-like article with holder means at a location toward the fixture;

moving the holder means while maintaining the portion which extends from the fixture declined downward, bringing the lower surface of said portion into abutment against a top end of the partition at a location which is adjacent to a particular vessel around which the sheet-like article is to be fitted;

relatively moving the holder means toward said particular vessel until the holder means is located above the particular vessel, whereupon the abutment of the sheet-like article against the top end of the partition is terminated;

and fitting the sheet-like article around the particular vessel while it is inserted into a space defined by the partition in which the particular vessel is received.

2. A method of fitting a sheet-like article including a fixture with an opening formed therein which is adapted to be fitted around the neck of a vessel and a portion extending from the fixture around a vessel contained in a case, comprising the steps of holding a sheet-like article with holder means at a location toward the fixture;

moving the holder means;

bringing the portion which extends from the fixture into abutment against a sidewall of the case or a flap extending above the sidewall while maintaining said portion declined downward;

relatively moving the holder means while maintaining the abutment to position the opening in the fixture above the neck of a vessel in the case;

subsequently causing the holder means to move down to fit the sheet-like article around the neck of the vessel.

3. An apparatus for fitting a sheet-like article including a fixture with an opening formed therein which is adapted to fit around the neck of a vessel and a portion extending from the fixture around a vessel contained in a case having a partition, comprising holder means for holding the sheet-like article at a location toward the fixture;

and moving means for moving the holder means up and down and in a horizontal direction;

the moving means causing the holder means to move down while maintaining the portion extending from the fixture declined downward to bring the lower surface of said portion into abutment against the top end of the partition which defines a space for a particular vessel around which the sheet-like article is to be fitted, subsequently the moving means relatively moving the holder means toward the vessel under the condition of abutment to terminate the abutment of the sheet-like article against the top end of the partition and then moving the holder means down to fit the sheet-like article around the vessel while maintaining the sheet-like article inserted in a space defined by the partition in which the particular vessel is received.

4. An apparatus for fitting a sheet-like article around the neck of a vessel contained in a case, the sheet-like article including a fixture with an opening formed therein which is adapted to fit around the neck of the vessel and a portion extending from the fixture, comprising holder means for holding the sheet-like article at a location toward the fixture;

moving means for moving the holder means up and down and in a horizontal direction;

the moving means moving the holder means while maintaining said portion declined downward to bring said portion into abutment against a sidewall of the case or a flap disposed above the sidewall and relatively moving the holder means so that the opening in the fixture is located above the neck while maintaining the abutment, the moving means subsequently causing the holder means to move down to fit the sheet-like article around the vessel.

5. An apparatus according to claim 3, further comprising means for declining said portion downward.

6. An apparatus according to claim 3, in which the holder means includes a suction unit disposed at its bottom which is effective to hold part of the sheet-like article attracted thereto from above, the holder means further includes a retaining member which is elevatable relative to the suction unit, the retaining member having a lower end which projects below the sheet-like article which is held attracted by the suction unit, whereby the sheet-like article is held while it is maintained declined downward.

7. An apparatus according to claim 4, further comprising means for declining said portion downward.

8. An apparatus according to claim 4, in which the holder means includes a suction unit disposed at its bottom which is effective to hold part of the sheet-like article attracted thereto from above, the holder means further includes a retaining member which is elevatable relative to the suction unit, the retaining member having a lower end which projects below the sheet-like article which is held attracted by the suction unit, whereby the sheet-like article is held while it is maintained declined downward.

* * * * *